US007905569B2

(12) United States Patent
Bell et al.

(10) Patent No.: US 7,905,569 B2
(45) Date of Patent: Mar. 15, 2011

(54) PLANARIZATION LAYER FOR MICRO-FLUID EJECTION HEAD SUBSTRATES

(75) Inventors: Byron V. Bell, Paris, KY (US); Craig M. Bertelsen, Union, KY (US); Brian C. Hart, Georgetown, KY (US); Girish S. Patil, Lexington, KY (US); Sean T. Weaver, Union, KY (US)

(73) Assignee: Lexmark International, Inc., Lexington, KY (US)

( * ) Notice: Subject to any disclaimer, the term of this patent is extended or adjusted under 35 U.S.C. 154(b) by 1094 days.

(21) Appl. No.: 10/941,493

(22) Filed: Sep. 15, 2004

(65) Prior Publication Data

US 2006/0055723 A1 Mar. 16, 2006

(51) Int. Cl.
*B41J 2/015* (2006.01)
*B41J 2/05* (2006.01)

(52) U.S. Cl. ..... 347/20; 347/63; 347/67

(58) Field of Classification Search ..... 347/20, 347/40, 47, 49, 50, 63, 67, 71; 216/27; 438/626, 438/787, 723
See application file for complete search history.

(56) References Cited

U.S. PATENT DOCUMENTS

| | | | |
|---|---|---|---|
| 5,413,963 | A | 5/1995 | Yen et al. |
| 5,631,197 | A | 5/1997 | Yu et al. |
| 5,728,453 | A | 3/1998 | Wang et al. |
| 5,913,142 | A | 6/1999 | Chang |
| 6,211,097 | B1 | 4/2001 | Chen et al. |
| 6,315,397 | B2 | 11/2001 | Truninger et al. |
| 6,727,184 | B1 | 4/2004 | Wang et al. |

*Primary Examiner* — Shih-Wen Hsieh
(74) *Attorney, Agent, or Firm* — Luedeka Neely & Graham

(57) ABSTRACT

A substantially inorganic planarization layer for a micro-fluid ejection head substrate and method therefor. The planarization layer includes a plurality of layers composed of one or more dielectric compounds and at least one spin on glass (SOG) layer having a total thickness ranging from about 1 microns to about 15 microns deposited over a second metal layer of the micro-fluid ejection head substrate. A top most layer of the planarization layer is selected from one or more of the dielectric compounds and a hard mask material.

12 Claims, 12 Drawing Sheets

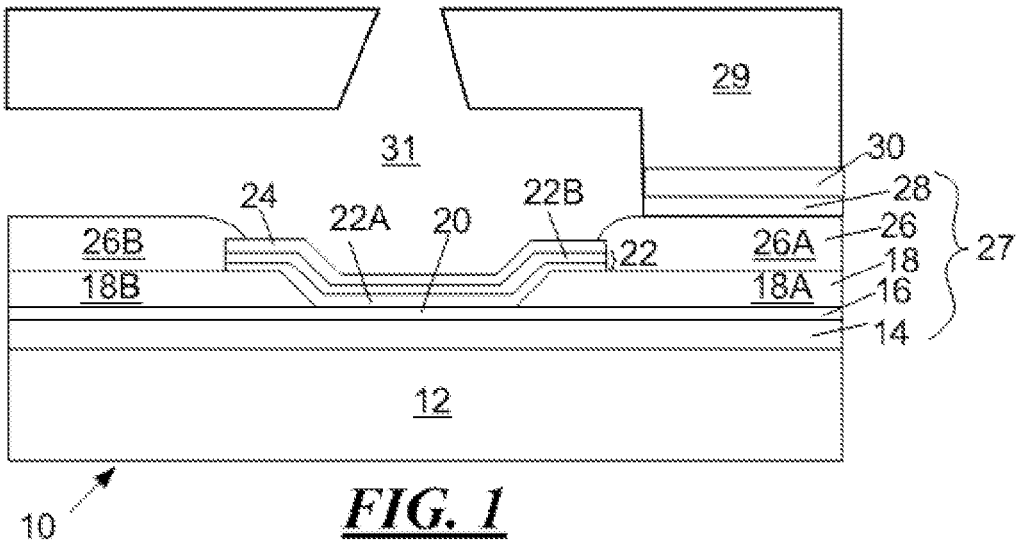
FIG. 1
Prior Art
FIG. 2
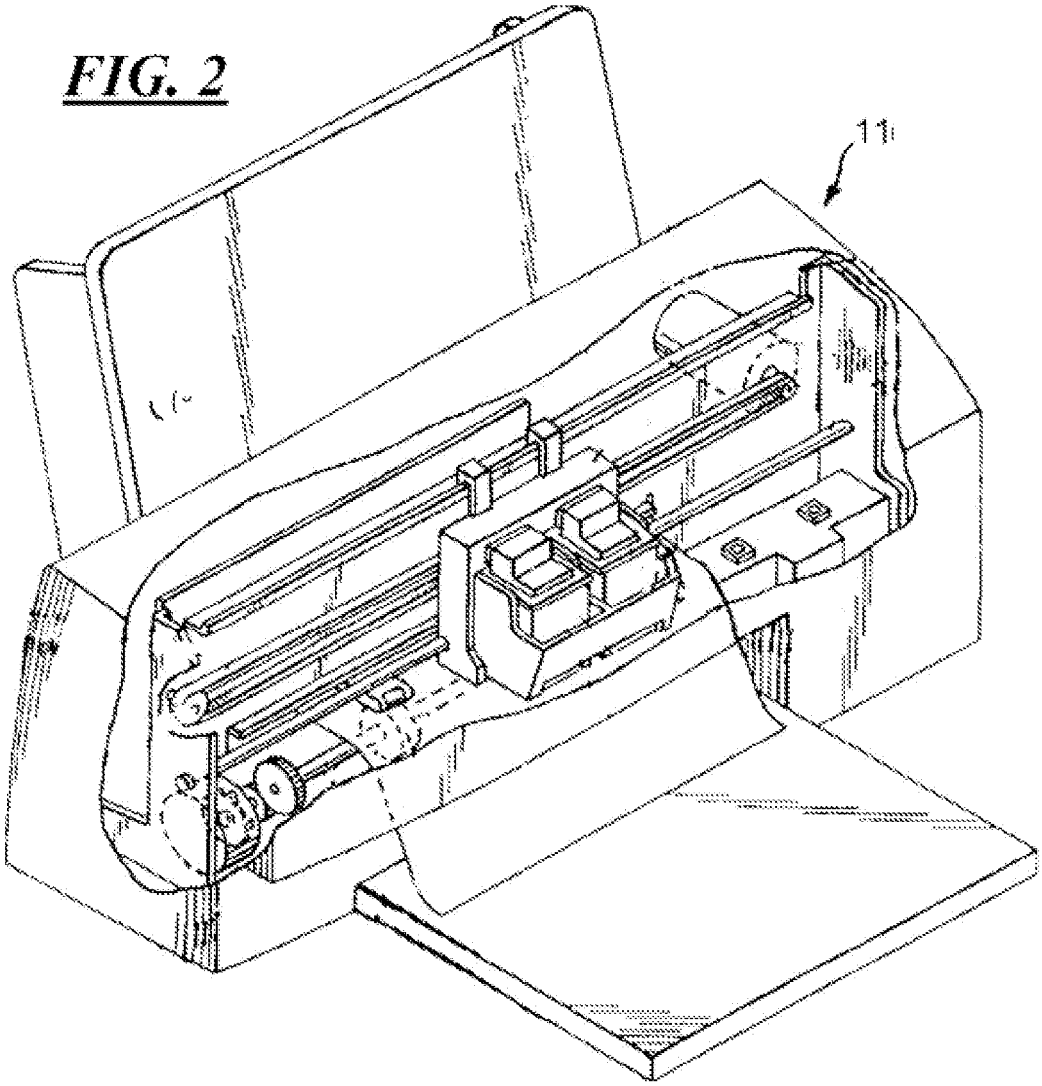

124

PLANARIZATION LAYER FOR MICRO-FLUID EJECTION HEAD SUBSTRATES

FIELD OF THE DISCLOSURE

The disclosure relates to micro-fluid ejection head structures and in particular to compositions and methods that are effective for planarizing the surface of micro-fluid ejection head substrates.

BACKGROUND

Micro-fluid ejection heads containing micro-fluid ejection head substrates have been used in various devices for a number of years. A common use of micro-fluid ejection head substrates includes ink jet heater chips found in ink jet printheads. Despite their seeming simplicity, construction of micro-fluid ejection head substrates requires consideration of many interrelated factors for proper functioning.

The primary component of the micro-fluid ejection head is the micro-fluid ejection head substrate. The substrate is a semiconductor substrate containing a plurality of layers of insulative, resistive, and conductive materials which provide a plurality of fluid jet actuators on a device surface of the substrate. For example, in one conventional process, after etching selected portions of a first metal layer deposited on the substrate to form certain connections and/or contacts, additional layers (such as layers of tantalum, silicon carbide, and silicon nitride over a layer of tantalum/tantalum aluminum) are deposited and etched to form heater structures on the substrate.

An intermetal dielectric ("IMD") layer, such as a silicon oxide/spin on glass ("SOG")/silicon oxide layer, on the order of about one micron, is then deposited on the substrate. The SOG is deposited to flatten the topography of the substrate, while the silicon oxide ("silox") is used to seal the SOG. After etching portions of the IMD layer (e.g., in via and heater locations), a second layer of metal is deposited and etched to provide further connections on the device surface of the substrate.

A nozzle plate is laminated, as by an adhesive, to the device surface of the substrate to provide the micro-fluid ejection head. It will be appreciated that, on a micro-scale, the plurality of layers on the device surface of the substrate provide a relatively non-planar surface. Accordingly, a problem exists with respect to lamination of materials to the device surface of the substrate.

An important aspect of a conventional micro-fluid ejection head substrate includes the use of a planarization layer. The planarization layer acts to planarize the device surface of the substrate to ensure suitable adhesion of structures such as the nozzle plate. Another purpose of a planarization layer is to serve as a passivation layer for protecting the device surface of the substrate from corrosion associated with fluid leakage. For example, planarization layers commonly used for conventional inkjet printheads provide protective and planarizing functions. Such layers, however, pose a number of problems with regard to production, operation, and function.

In the aforementioned conventional process, an organic material, such as an epoxy photoresist material, is applied, at another facility, over the second metal layer on the device surface of the substrate to provide planarization and passivation functions. In order to form fluid supply slots in the substrate, a photoresist mask material is applied to the planarization layer to protect the planarization layer and device surface of the substrate. Subsequent to forming fluid supply slots in the substrate, the photoresist mask material is removed, preferably without removing the planarization layer. However, organic planarization layer materials are sensitive to processes such as grit blasting, deep reactive ion etching (DRIE), and solvent washing which may be used to remove the photoresist mask material. Accordingly, methods effective to remove the photoresist mask material without adversely affecting an organic planarization layer often result in photoresist mask material residue remaining on vital areas such as bond pads where good electrical connection is essential.

With regard to the above, there remains a need for improved planarization layers and techniques to ensure adequate substrate planarization and corrosion protection while, at the same time, minimizing manufacturing difficulties for micro-fluid ejection head substrates.

SUMMARY

With regard to the above, there is provided in one embodiment a substantially inorganic planarization layer for a micro-fluid ejection head substrate. The planarization layer includes a plurality of layers composed of one or more dielectric compounds and at least one spin on glass (SOG) layer and has a thickness ranging from about 1 microns to about 15 microns. The planarization layer is deposited over a second metal layer of the micro-fluid ejection head substrate. A top most layer of the plurality of layers is selected from one or more of the dielectric compounds and a hard mask material.

In another embodiment, there is provided a method of making a micro-fluid ejection head structure. According to the method, a first sub-layer derived from a dielectric compound is deposited over a device surface of a semiconductor substrate containing insulative, conductive, and passivation layers. A second sub-layer derived from spin on glass (SOG) is deposited over the first sub-layer to provide a sub-layer stack. A hard mask material is deposited over the sub-layer stack. The sub-layer stack and hard mask provide a substantially inorganic planarization layer for the substrate. A photoresist material is deposited over the hard mask material, and is imaged and developed to define flow features in the photoresist material. Subsequently, the hard mask material is etched to define the flow features therein, and the photoresist material is removed from the hard mask material. Flow features are etched into the sub-layer stack to provide a planarized micro-fluid ejection head structure containing flow features in the planarization layer.

An advantage of exemplary embodiments of the foregoing structure and method therefor is that the planarization layer may be applied to the substrate at a wafer fabricator's facility thereby improving the uniformity of the planarization layer on the wafer. Furthermore, a multi-layer substantially inorganic planarization layer may be tailored to a specific thickness using relatively thin sub-layers thereby reducing a tendency for the planarization layer to crack during subsequent handling and ejection head processing. Moreover, the multi-layered inorganic planarization layer is significantly more resistant than an organic planarization layer to grit blasting, DRIE, solvent treatment, and other similar treatments used to remove a photoresist mask material from the substrate. In other words, more powerful stripping techniques may be used with a substrate containing a multi-layered inorganic planarization layer to ensure cleaner contact areas such as, for example, bond pads on inkjet printhead structures.

For the purposes of this disclosure, the term "top most" denotes an exposed layer rather than an indication of direction. The term "flow features" includes, but is not limited to a fluid supply slot, a fluid flow channel, and a fluid ejection chamber, or a portion of a fluid flow channel or fluid ejection chamber.

BRIEF DESCRIPTION OF THE DRAWINGS

Further advantages of the disclosure may be apparent by reference to the detailed description of exemplary embodiments when considered in conjunction with the following drawings, in which like reference numbers denote like elements throughout the several views, wherein features have been exaggerated for ease of understanding and are not intended to be illustrative of relative thicknesses of the features, and wherein:

FIG. 1 is a cross-sectional view, not to scale, of a portion of a prior art micro-fluid ejection head;

FIG. 2 is an illustration, in perspective view, of a conventional micro-fluid ejection device in the form of a printer.

DETAILED DESCRIPTION OF THE EXEMPLARY EMBODIMENTS

Figure 3A:
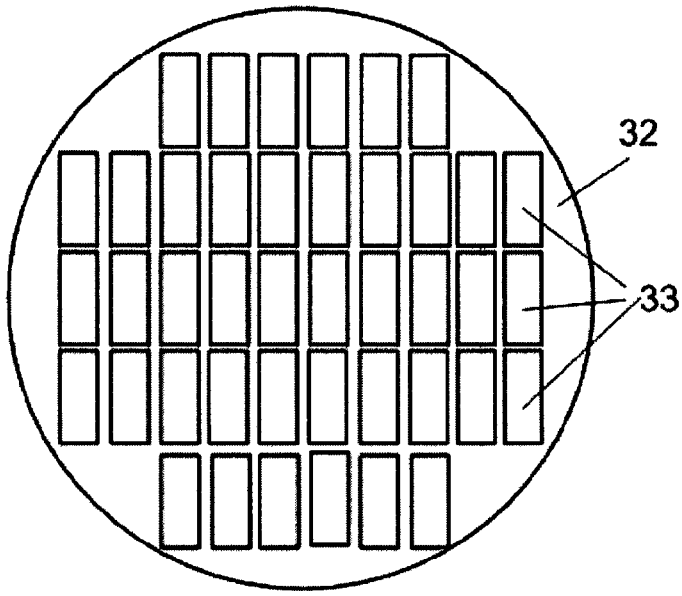
FIG. 3A is a plan view, not to scale, of a substrate wafer containing a plurality of semiconductor substrates according to one embodiment of the disclosure.

With reference to FIG. 1, there is illustrated in a cross-sectional view, not to scale, a portion of a prior art micro-fluid ejection head 10 for a micro-fluid ejection device such as a printer 11 (FIG. 2). The micro-fluid ejection head 10 includes a semiconductor substrate 12, typically made of silicon. An insulating layer 14, selected from silicon dioxide, phosphorus doped glass (PSG) or boron and phosphorus doped glass (BSPG) is deposited or grown on the semiconductor substrate. The insulating layer 14 has a thickness ranging from about 8,000 to about 30,000 Angstroms. The semiconductor substrate 12 typically has a thickness ranging from about 100 to about 800 microns or more.

A resistive layer 16 is deposited on the insulating layer 14. The resistive layer 16 may be selected from TaAl, $Ta_2N$, TaAl(O,N), TaAlSi, TaSiC, Ti(N,O), WSi(O,N), TaAlN and TaAl/Ta and has a thickness ranging from about 500 to about 1,500 Angstroms.

A conductive layer 18 is deposited on the resistive layer 16 and is etched to provide power and ground conductors 18A and 18B for a heater resistor 20 defined between the power and ground conductors 18A and 18B. The conductive layer 18 may be selected from conductive metals, including but not limited to, gold, aluminum, silver, copper, and the like and has a thickness ranging from about 4,000 to about 15,000 Angstroms.

A passivation layer 22 is deposited on the heater resistor 20 and a portion of conductive layer 18 to protect the heater resistor 20 from fluid corrosion. The passivation layer 22 typically consists of composite layers of silicon nitride (SiN) 22A and silicon carbide (SiC) 22B with SiC being the top layer. The passivation layer 22 has an overall thickness ranging from about 1,000 to about 8,000 Angstroms.

A cavitation layer 24 is then deposited on the passivation layer overlying the heater resistor 20. The cavitation layer 24 has a thickness ranging from about 1,500 to about 8,000 Angstroms and is typically composed of tantalum (Ta). The cavitation layer 24, also referred to as the "fluid contact layer" provides protection of the heater resistor 20 from erosion due to bubble collapse and mechanical shock during fluid ejection cycles.

Overlying the power and ground conductors 18A and 18B is another insulating layer or dielectric layer 26 typically composed of epoxy photoresist materials, polyimide materials, silicon nitride, silicon carbide, silicon dioxide, spin-on-glass (SOG), laminated polymer and the like. The insulating layer 26 provides insulation between a second conductive layer 28 and conductive layer 18 and has a thickness ranging from about 5,000 to about 20,000 Angstroms.

The second conductive layer 28, disposed on the surface of the insulating layer 26 is typically composed of gold, aluminum, copper, and the like. The second conductive layer provides electrical continuity to the conductors 18A and 18B from a power source and has a thickness ranging from about 500 to about 10,000 Angstroms. The foregoing layers and substrate of such an embodiment are referred to herein as the "substrate 12 and device layers 27."Conventional microelectronic fabrication processes such as physical vapor deposition (PVD), chemical vapor deposition (CVD), or sputtering may be used to provide the various layers on the silicon substrate 12.

Prior to attaching a nozzle plate 29 to the device layers 27, a planarization layer 30 is deposited on the device layers 27. The planarization layer 30 is used to ensure proper adhesion of the substrate 12 and device layers 27 to other surfaces including the nozzle plate 29. Typical planarization layers 30 used on conventional micro-fluid ejection head structures are composed of epoxy photoresist materials which may be spin-coated or laminated onto the device layers 27. Planarization layer 30 thicknesses generally range from about 1 to about 15 microns. Prior to attaching the nozzle plate 29 to the planarization layer 30, the planarization layer 30 is imaged and developed to expose fluid in a fluid chamber 31 to the heater resistor 20.

A disadvantage of a conventional planarization layer, for example layer 30 in FIG. 1, and production of ejection heads 10 containing the planarization layer 30, is that the planarization layer 30 is currently applied to substrate wafers after shipment to various micro-fluid ejection head production facilities.

A substrate wafer 32 as produced at a manufacturing facility is illustrated in FIG. 3A. The substrate wafer 32 is a relatively flat plate and includes a plurality of substrates 12 having device layers 27 thereon defining a plurality of micro-fluid ejection head semiconductor substrates 33. In a conventional wafer production facility, the substrate wafer 32 is produced without the planarization layer 30. Application of a planarization layer 30 at the wafer production facility may enable a micro-fluid ejection head production facility to begin etching the semiconductor substrates 33 to provide flow features, including fluid supply slots 35 (FIG. 3B) therein as soon as the substrate wafer 32 is received by the micro-fluid head production facility.

Another disadvantage of a conventional planarization layer 30 is related to the use for planarizing device layers 27 of micro-fluid ejection head structures 10. As described above, conventional planarization layers 30 are typically organic materials which react sensitively to grit blasting, deep reactive ion etching (DRIE), solvent treatment, and other similar treatments used to strip photoresist mask materials from the planarization layer 30 and device layers 27. Aggressive stripping techniques for removing the photoresist mask materials from the planarization layer 30 and device layers 27 in critical areas such as contact pads, often degrade the passivation function of the planarization layer 30 in areas where removal of planarization layer 30 is not desired.

Figure 4:
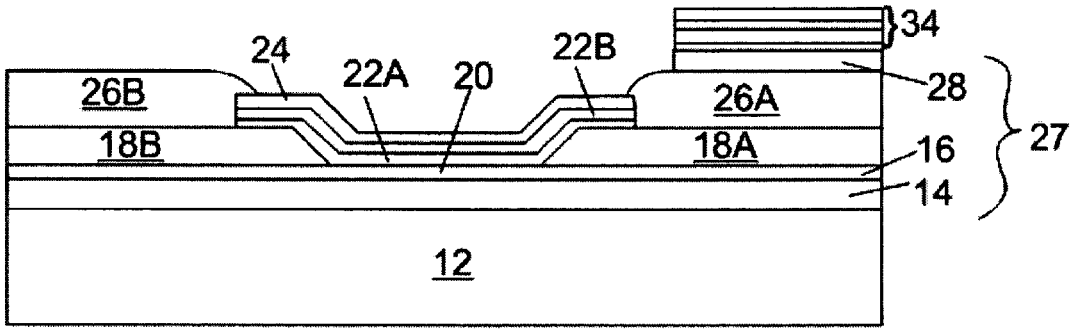
FIG. 4 is a cross-sectional view, not to scale, of a portion of a micro-fluid ejection head substrate containing a planarization layer according to one embodiment of the disclosure.

In order to provide a more robust planarization layer that is suitable for aggressive treatment used for photoresist mask removal from the planarization layer and device layers 27, an inorganic planarization layer 34 can be provided (FIG. 4). The planarization layer 34 differs from planarization layer 30 in many ways, including its structure. Planarization layer 34 is composed of alternating layers of one or more dielectric materials and spin on glass (SOG).

Figure 5A:
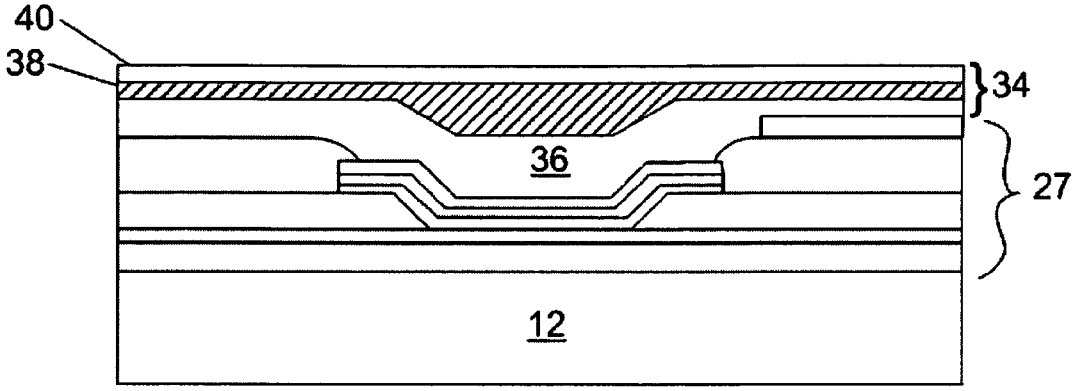
FIG. 5A is a cross-sectional view, not to scale, of a portion of a micro-fluid ejection head substrate containing a planarization layer according to one embodiment of the disclosure.

FIG. 5A illustrates one embodiment of the disclosure in which planarization layer 34 is composed of a first layer of silicon oxide 36, a second layer of spin on glass 38, and a third layer of silicon oxide 40. For purposes of the disclosure, references to "silicon oxide" are intended to include, silicon mono-oxide, silicon dioxide and $SiO_x$ wherein x ranges from about 1 to about 4. The alternating layers of silicon oxide 36, spin on glass 38, and silicon oxide 40 providing the planarization layer 34 are also referred to as a "silox/SOG/silox" layer.

The layers 36, 38, and 40 are deposited over (e.g., on) the device layers 27 (e.g., an exposed surface of the device layers) of the semiconductor substrates 33 defined on wafer 32 (FIG. 3A). Accordingly, FIG. 5A provides a cross-sectional view of a portion of the substrate wafer 32 illustrating the planarization layer 34. The silox/SOG/silox planarization layer 34 has a thickness ranging from about 1 micron to about 10 microns. A planarizing function is achieved primarily by one or more spin on glass sub-layers 38, while the dielectric sub-layers 36 and 40 provide a passivation function. Overall, the planarization structure 34 conforms better to the topography of micro-fluid ejection head substrates 33 than conventional planarization layers.

An important benefit of some embodiments of the planarization layer 34 can be that a thicker overall planarization layer 34 may be provided while minimizing the risk of cracking of the planarization layer. Increased thickness of the planarization layer 34, to a certain degree, might be desirable because a thicker layer 34 normally corresponds with better planarization. A thicker layer 34 may also increase the passivating function, if any, of the planarization layer 34.

Figure 5B:
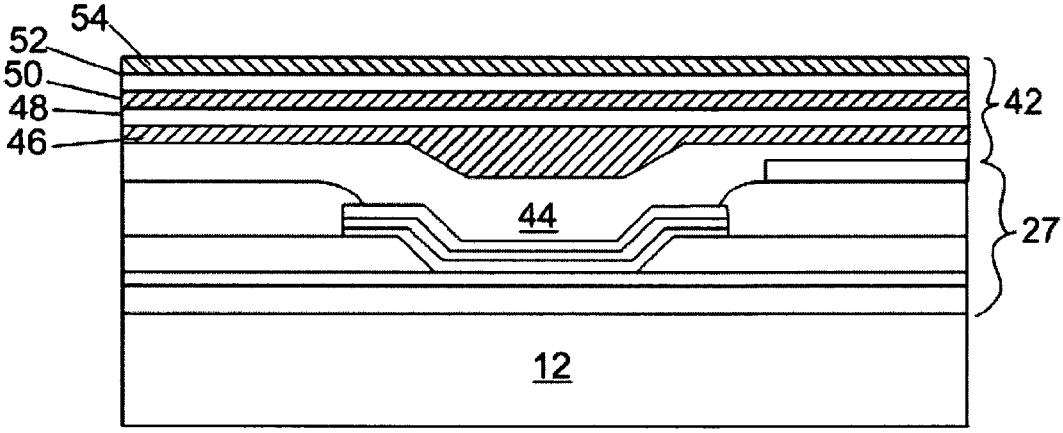
FIG. 5B is a cross-sectional view, not to scale, of a portion of a micro-fluid ejection head substrate containing a planarization layer according to another embodiment of the disclosure.

In another embodiment illustrate in FIG. 5B, a planarization layer 42 may include a first layer of silicon oxide 44, a second layer of spin on glass 46, a third layer of silicon oxide 48, a fourth layer of spin on glass 50, a fifth layer of silicon oxide 52, and a top most layer or hard mask layer 54 of diamond-like carbon (DLC) or silicon nitride with a total thickness of about 3 microns, all disposed over (e.g., on) the device layers 27 of the semiconductor substrates 33 (FIG. 3A).

As will be appreciated by those skilled in the art, the hard mask 54 may be applied to any embodiment of this disclosure. The hard mask 54 can protect the underlying layers 44, 46, 48, 50, and 52 during etching because conventional photoresist etch mask layers may not offer adequate protection. It will also be appreciated that inorganic planarization layers 34 and 42 are generally more time consuming to etch than conventional organic planarization layers 30 (FIG. 1), and the extended time often translates into increased etching stress on photoresist etch mask layers. However, the use of a hard mask 54 can negate the necessity of using a photoresist etch mask by protecting the underlying planarization layers 44-52 that are not to be etched during the etching process.

Figure 5C:
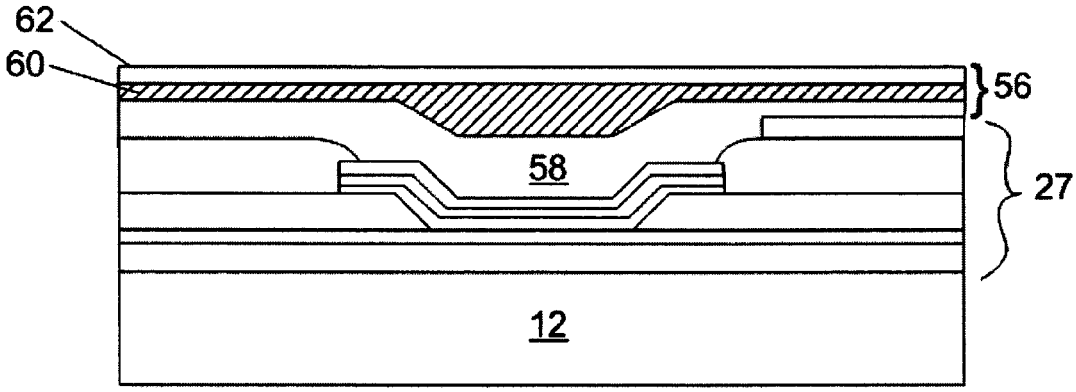
FIG. 5C is a cross-sectional view, not to scale, of a portion of a micro-fluid ejection head substrate containing a planarization layer according to still another embodiment of the disclosure.

Still another embodiment of the disclosure is illustrated in FIG. 5C wherein the structure includes a planarization layer 56 composed of a first layer of silicon nitride layer 58, a second layer of spin on glass 60, and a third layer of silicon nitride 62 disposed on the device layers 27 of the semiconductor substrates 33 (FIG. 3A). In this embodiment, silicon nitride is used in the dielectric sub-layers 58 and 62 instead of silicon oxide. As set forth above, a hard mask material may also be applied to the silicon nitride layer 62 to provide an etch mask.

Figure 5D:
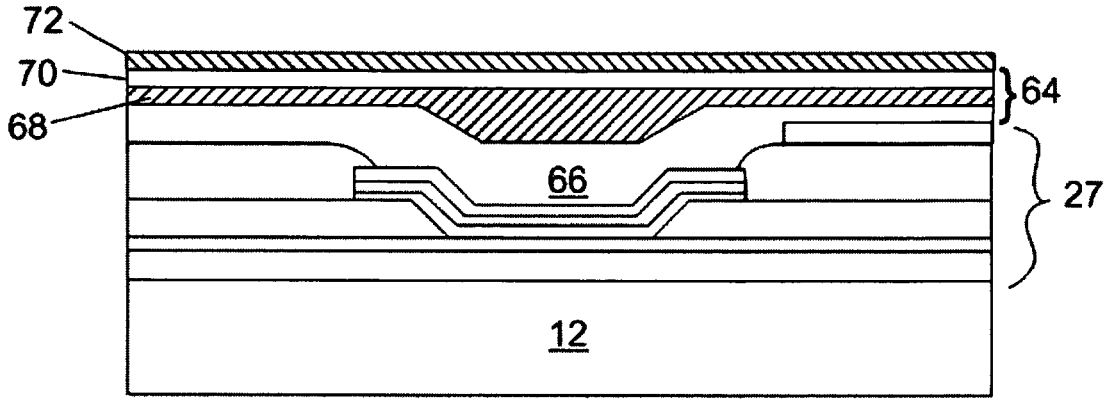
FIG. 5D is a cross-sectional view, not to scale, of a portion of a micro-fluid ejection head substrate containing a planarization layer according to yet another embodiment of the disclosure.

FIG. 5D illustrates another embodiment, providing planarization layer 64, in which the first layer 66 is composed of a dual layer of silicon carbide and silicon oxide. The second layer 68 is composed of spin on glass, the third layer 70 is composed of silicon oxide, and the fourth layer 72 is a hard mask of diamond-like carbon (DLC). All four layers are disposed over (e.g., on) the device layers 27 of the semiconductor substrates 33 (FIG. 3A). In this embodiment, the dielectric sub-layer 66 is provided by depositing sub-layers of different dielectric materials over (e.g., on) the device layers 27.

As set forth above, the overall thickness of the planarization layers 34, 42, 56, and 64 may range from about 1 to about 15 microns. Accordingly, each layer may have a thickness ranging from about 0.25 to about 5 microns. Of the layers in the planarization layers 34, 42, 56, and 64, the spin on glass layer is more effective with respect to a planarization function, while the dielectric layers are more conformal to the topography of the substrates 33. There is a practical minimum for the overall thickness of the planarization layers 34, 42, 56, and 64 in most embodiments as the layers should have sufficient thickness to achieve adequate planarization considering the second conductive layer 28 may have a thickness of about 1 micron or more. Hence, in an exemplary embodiment, the planarization layers 34, 42, 56, and 64 should have sufficient thickness to cover the thickness of the second conductive layer 28 and provide suitable planarization above the second conductive layer 28.

Figure 3B:
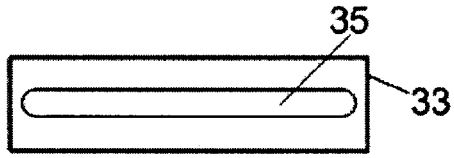
FIG. 3B is a plan view, not to scale, of a semiconductor substrate having a fluid feed slot etched therein.

Improvements over conventional planarization layers may be realized because the planarization layers 34, 42, 56, and 64 described above are substantially inorganic. Such inorganic materials may provide a more chemically and physically robust planarization layer 34, 42, 56, or 64 than a conventional planarization layer when the substrates 33 are subjected to grit blasting, deep reactive ion etching (DRIE), solvent treatment, and other aggressive micromaching processes for forming fluid supply slots 35 in the substrate 33 (FIG. 3B).

The ability to apply harsher etching steps during micro-fluid head substrate manufacture may ensure that important portions of micro-fluid ejection head substrates are more fully and more accurately etched and free from residue. For example, during the manufacturing of inkjet printheads, conventional planarization masking layers often leave a residue in bond pads areas after etching has been completed. Because harsher techniques could damage areas where etching is not desired due to the less robust characteristics of conventional planarization layers, the residue remains on the bond pads and often interferes with proper electrical communication within the finished micro-fluid ejection head product. Such residue problems may lead to lower product yields and less dependable products.

As will be appreciated by those skilled in the art, the dielectric sub-layers in the planarization layers 34, 42, 56, and 64 described herein may be composed of any material or materials with suitable electrical insulating properties. Such materials, include, but are not limited to, silicon oxide, silicon nitride, silicon carbide, diamond like carbon (DLC), and the like. As will also be appreciated by those skilled in the art, the number of alternating layers in the planarization layers 34, 42, 56, and 64 described herein are not limited by the embodiments disclosed. Accordingly, the number may vary from two total sub-layers to any number in which planarization may be achieved within a thickness of about 1 micron to about 15 microns.

In addition to the various embodiments of micro-fluid ejection head structures employing the planarization layer 34, 42, 56, 64, the disclosure also provides a method for making a micro-fluid ejection head structure including the steps of providing a substrate wafer with device layers 27 described with reference to FIG. 1.

Figure 6:
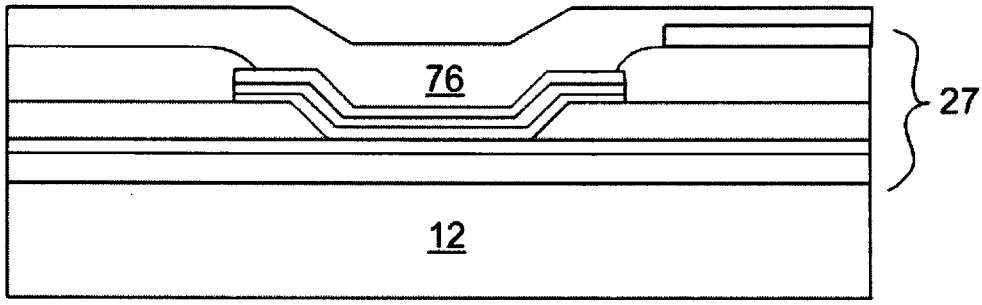
FIGS. 6-13 are cross-sectional views, not to scale, of portions of a micro-fluid ejection head substrate illustrating process steps for providing a planarization layer on the substrate according to one embodiment of the disclosure.
Figure 7:
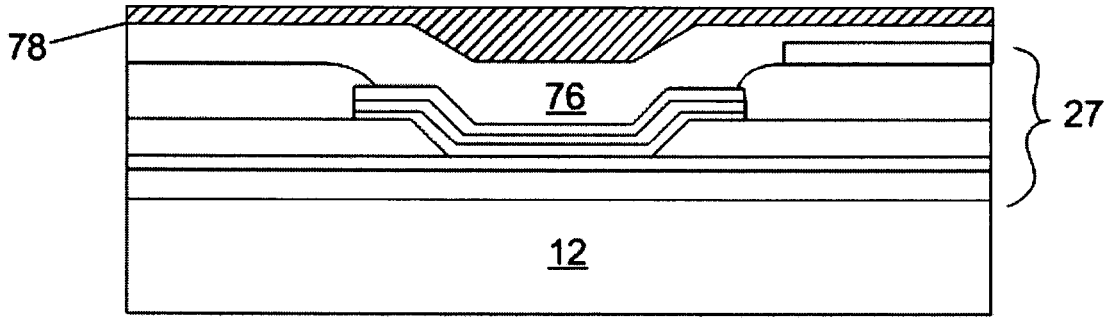
Figure 8:
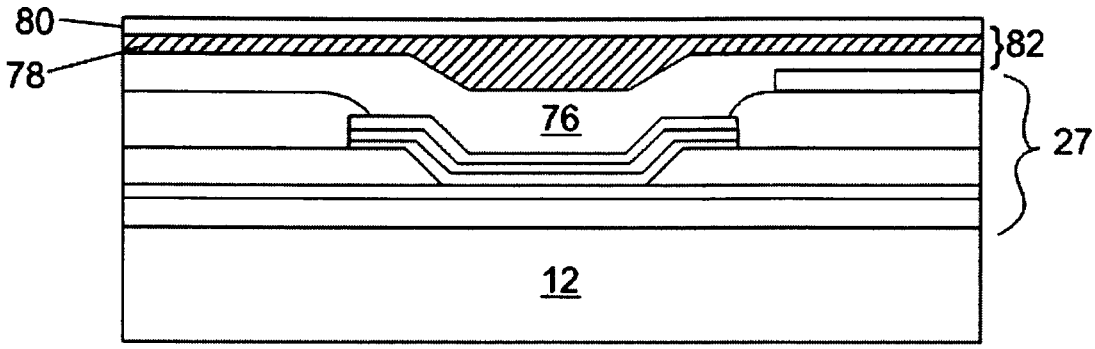
Figure 9:
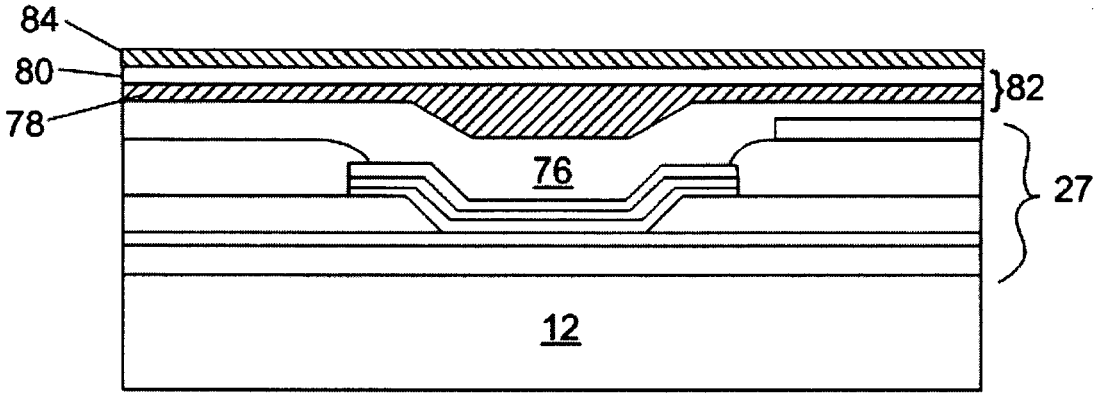

In one embodiment, as shown in FIG. 6, a first sub-layer 76 composed of a dielectric material is deposited over (e.g., on) the device layers 27 of semiconductors substrates 33 on wafer 32 (FIG. 3). A second sub-layer 78 composed of spin on glass (SOG) is then deposited over the first sub-layer 76 of dielectric material as shown in FIG. 7. A third step may include depositing a second dielectric layer 80 over the second sub-layer 78 of spin on glass as shown in FIG. 8. The first, and second sub-layers, 76 and 78 respectively, along with the third layer 80, provide a planarization layer 82. As shown in FIG. 9, a hard mask material 84 may be applied to the planarization layer 82 to, for example, provide etch resistance for the planarization layer 82.

Figure 10:
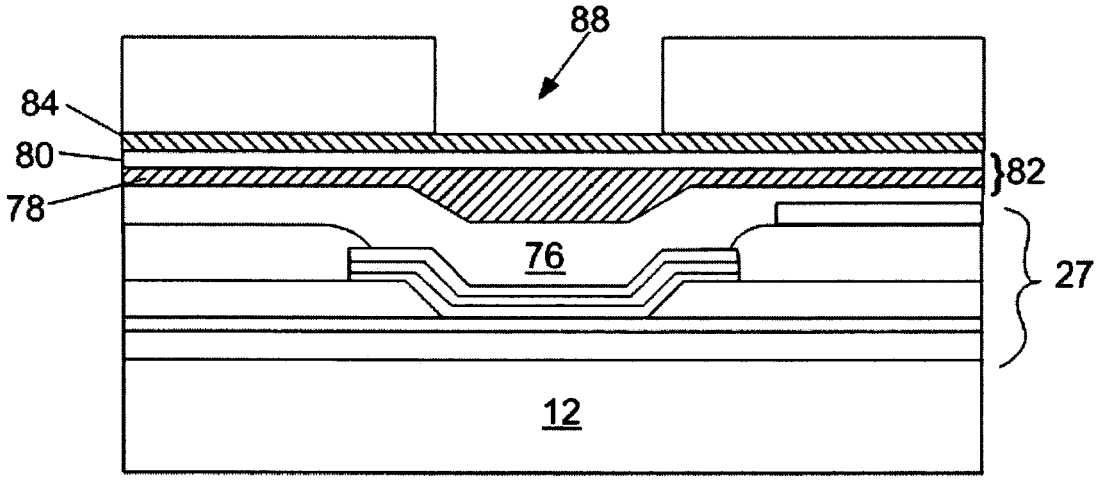

After the planarization layer 82 and hard mask layer 84 are formed, a photoresist layer 86 is deposited over the hard mask layer 84, such as by spin coating, laminating, or other suitable technique. The photoresist layer 86 is imaged and developed to provide an open area 88 within the photoresist layer 86, shown in FIG. 10 for etching the hard mask layer 84.

Figure 11:
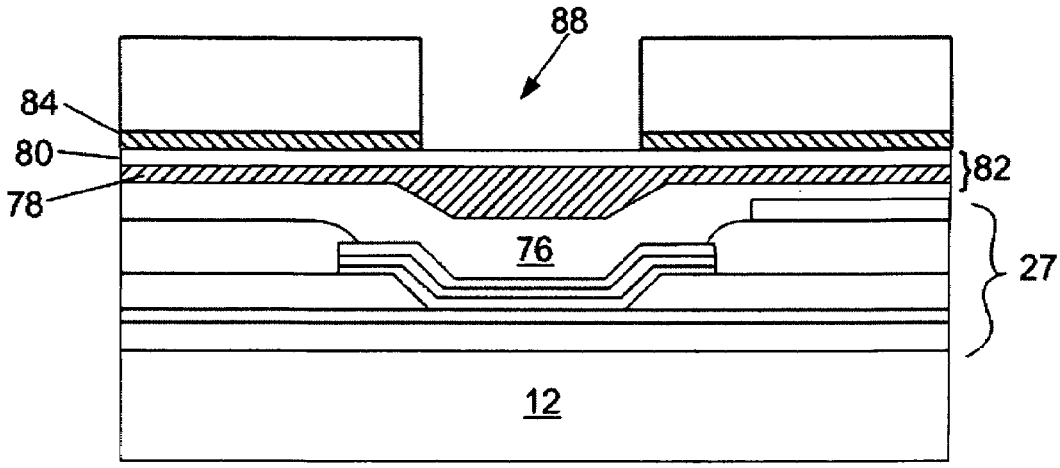
Figure 12:
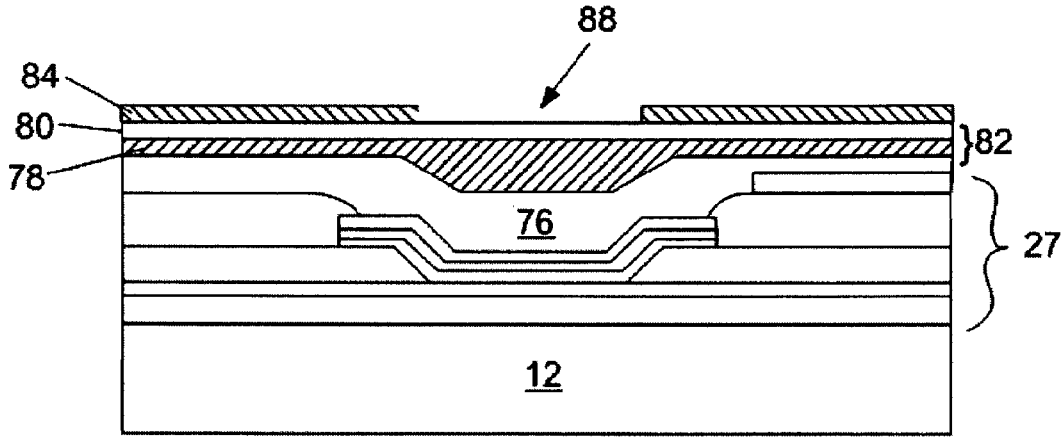
Figure 13:
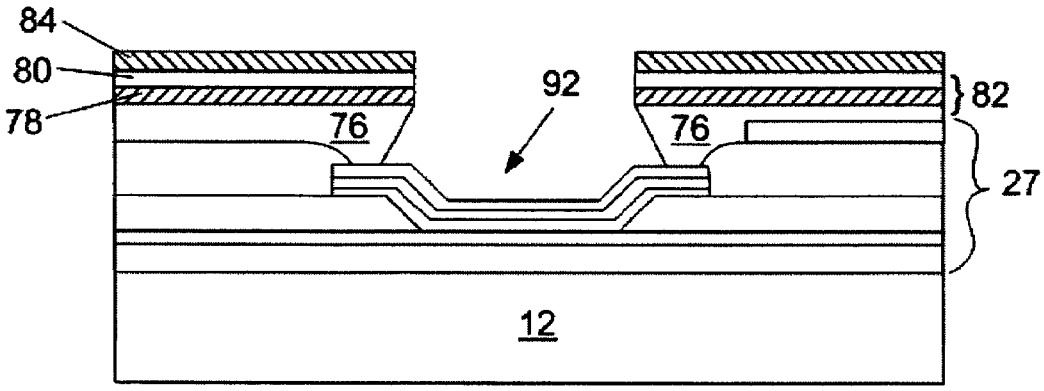

In FIG. 11, the hard mask 80 is etched to form the open area 88 within the hard mask layer 84 corresponding to the open area 88 in the photoresist layer 86. FIG. 12 shows the structure after the remaining photoresist layer 86 on the hard mask layer 84 is removed subsequent to etching the hard mask layer 84. At this point as shown in FIG. 12, etching resumes within the planarization layer 82 to provide an open area 92 within the spin on glass and dielectric layers 76, 78, and 80 adjacent the heater resistor 20 as shown in FIG. 13. Subsequent to providing open area 92, the hard mask 84 may be removed, if desired, from the planarization layer 82; however, removal of the hard mask 84 is not necessary.

The use of a photoresist layer 86 is well known in the art. Photoresist layer 86 may be either a positive or negative photoresist layer 86. If a positive photoresist layer 86 is used, for example, a portion of the photoresist resin layer that is exposed to radiation becomes soluble in a solvent, typically an alkaline solvent. The soluble part may be removed during a washing step using a solvent, leaving the insoluble portion to form a positive photoresist mask 86 as shown in FIG. 11. Subsequent etching of underlying layers 84 and 82 proceeds in the areas where the photoresist layer 86 has been removed during the developing step. As previously discussed, however, conventional organic photoresist layers like photoresist layer 86 do not provide adequate protection during extended etching processes which may be required for etching multiple inorganic layers providing planarization layer 82 as described here. Nonetheless, a conventional photoresist layer 86 may be used to provide an etch mask for etching the hard mask layer 84.

Figure 14:
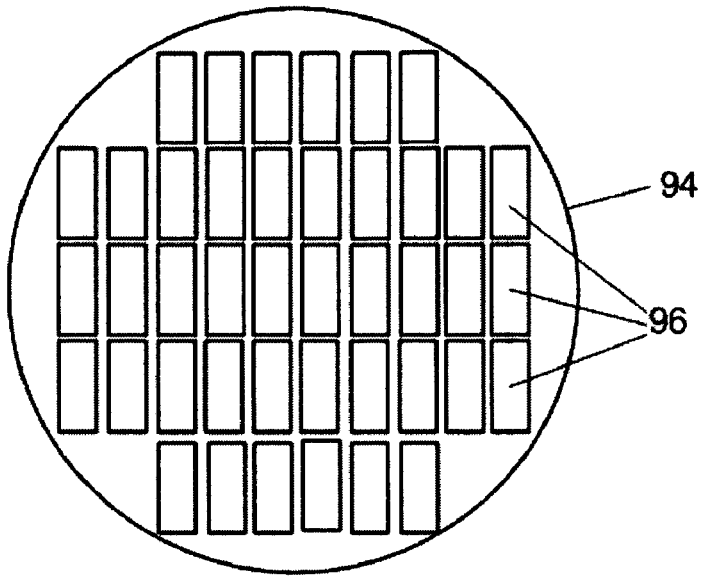
FIG. 14 is a plan view, not to scale, of a substrate wafer containing a plurality of semiconductor substrates according to another embodiment of the disclosure.

In yet another embodiment illustrated in FIGS. 14-26, a method for planarizing a semiconductor substrate for a micro-fluid ejection head is provided. The method includes the steps of depositing alternating layers of one or more dielectric compounds and spin on glass (SOG) over (e.g., onto) a surface of a wafer 94 containing semiconductor substrates 96 (FIG. 14).

Figure 15:
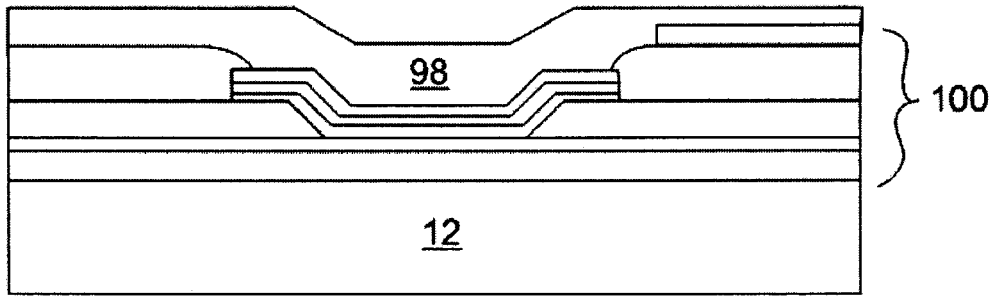
FIGS. 15-26 are cross-sectional views, not to scale, of portions of a micro-fluid ejection head substrate illustrating process steps for providing a micro-fluid ejection head according to yet another embodiment of the disclosure.
Figure 16:
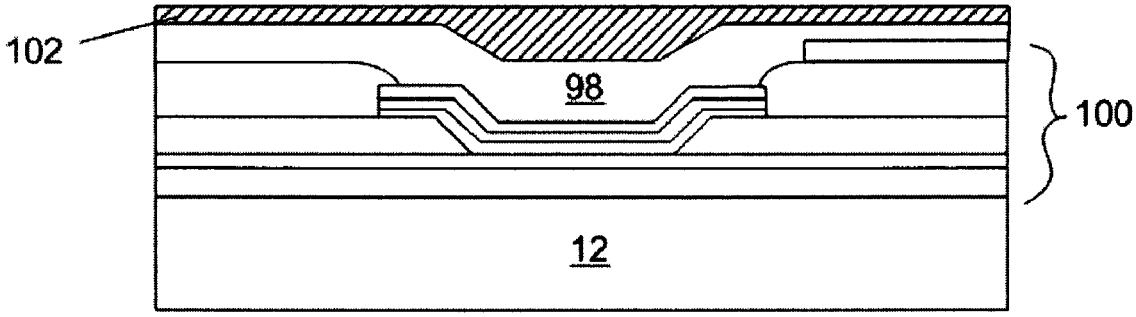
Figure 17:
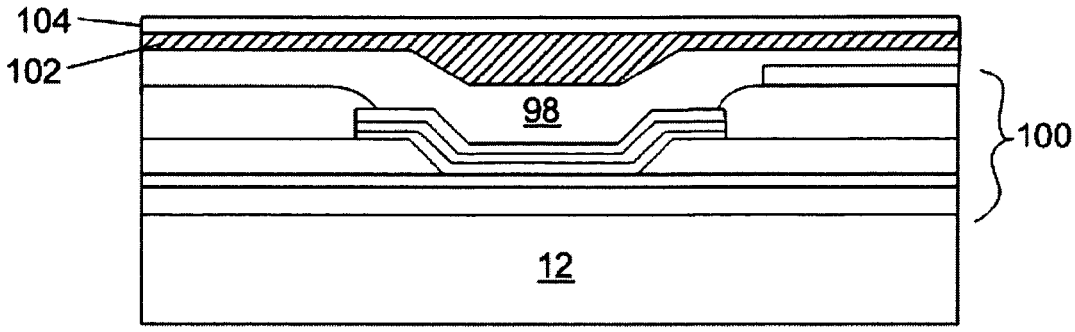
Figure 18:
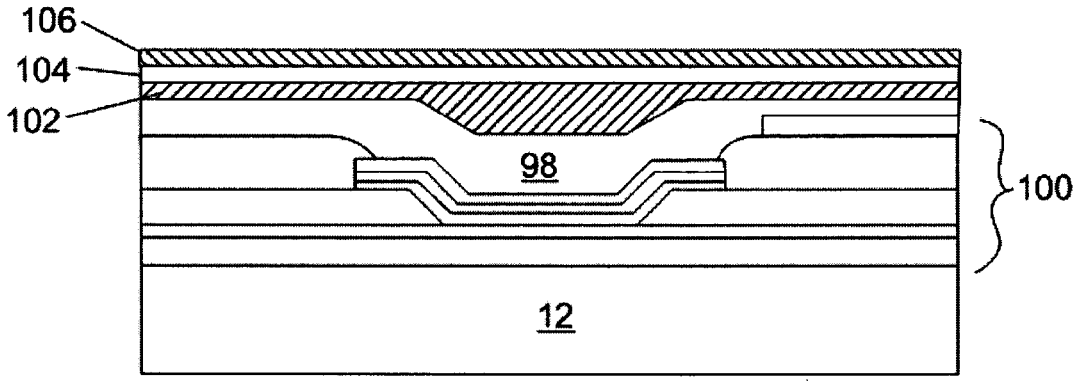
Figure 19:
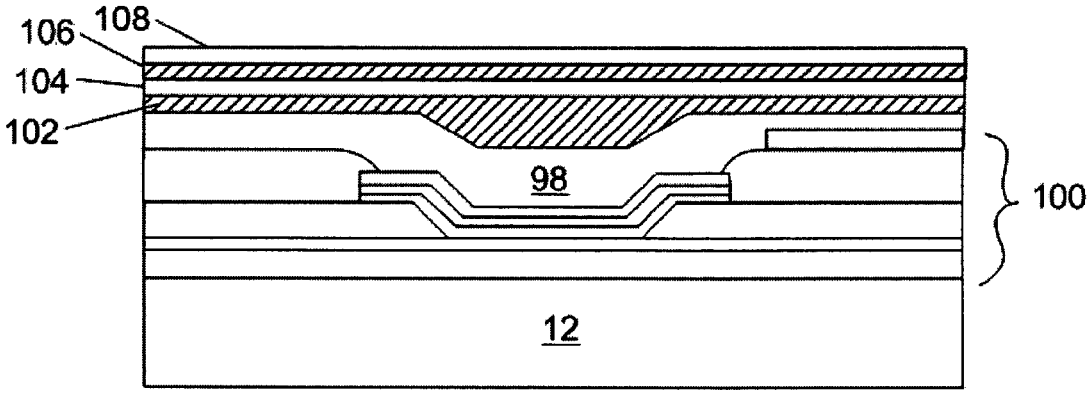

FIG. 15 illustrates a first step of depositing a first dielectric layer 98 over the device layers 100 of the substrates 96. Next, a first layer of spin on glass 102 is deposited as shown in FIG. 16. A second dielectric layer 104 is then deposited over the first spin on glass layer 102 as shown in FIG. 17. FIG. 18 illustrates the addition of the second layer of spin on glass 106 over the second dielectric layer 104. In FIG. 19, a third and final dielectric layer 108 for this embodiment is deposited over the second spin on glass layer 106.

Figure 20:
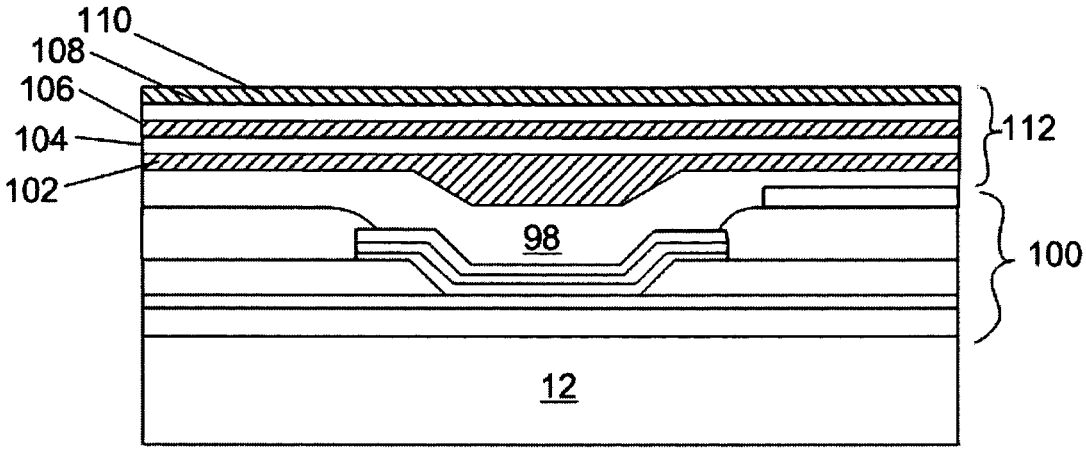
Figure 21:
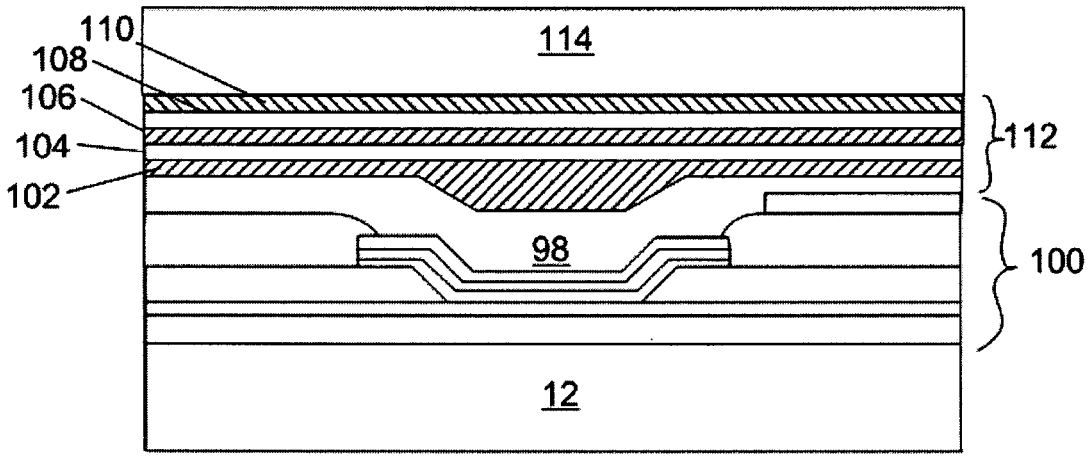

As before, the dielectric layers 98, 104, and 108 may be selected from silicon oxide, silicon nitride, silicon carbide, diamond like carbon (DLC) and the like. Each of the dielectric layers 98, 104, and 108 may be made of the same or different dielectric materials. After the alternating layers 98 and 102-108 of dielectric layer 98, 104, and 108 and spin on glass layer 102 and 104 have been deposited over the device layers 100 of the substrates 96, a hard mask layer 110 is applied over the stacked structure as shown in FIG. 20 to, for example, provide a planarization layer 112. The hard mask 110 may consist of diamond like carbon (DLC), silicon nitride, and the like.

Figure 22:
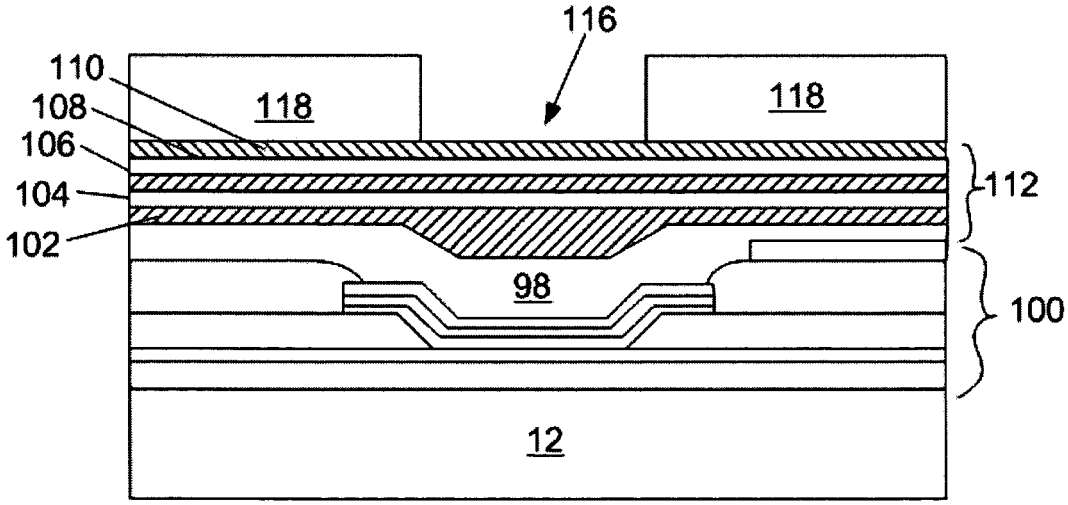
Figure 23:
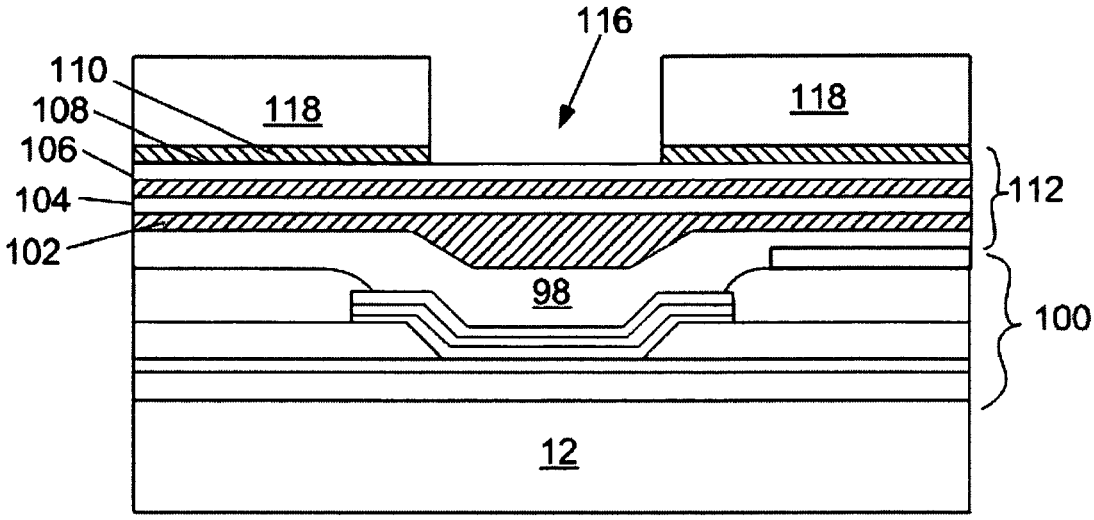
Figure 24:
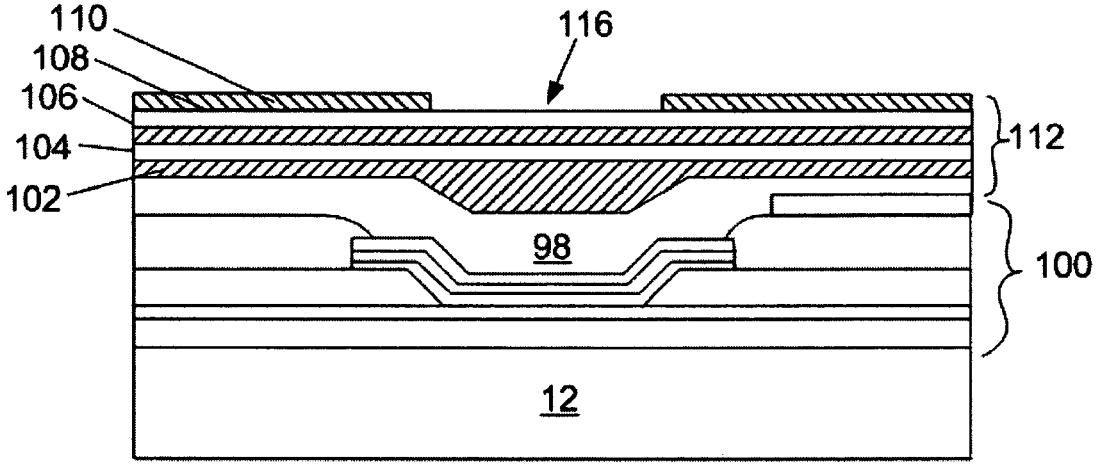
Figure 25:
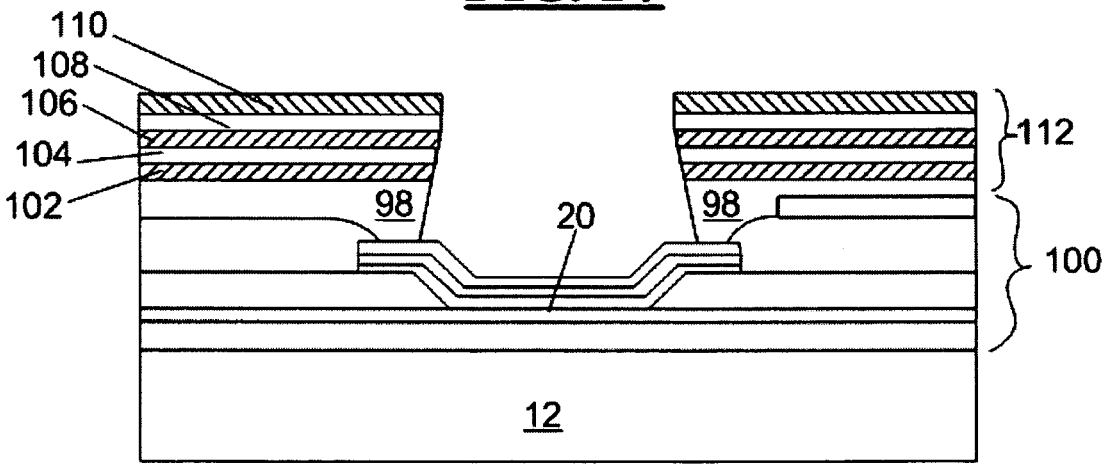
Figure 26:
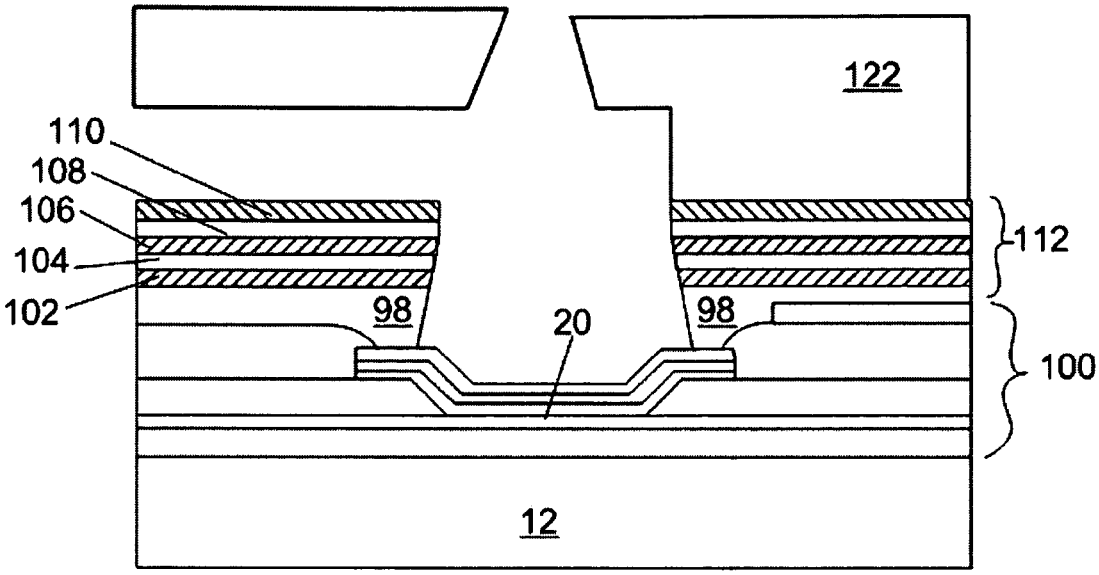
Figure 27:
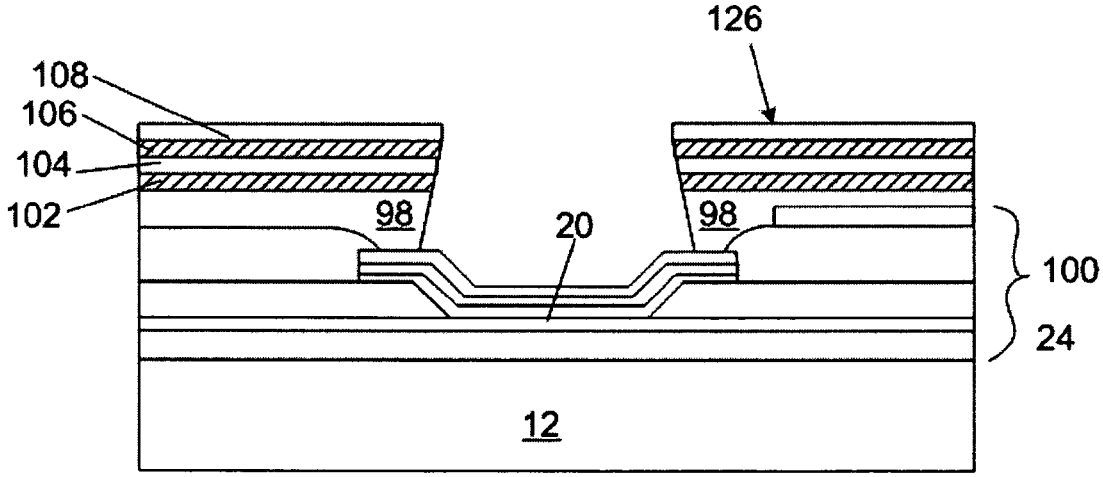
FIG. 27 is a cross-sectional view, not to scale, of a portion of a micro-fluid ejection head substrate containing a planarization layer according to still another embodiment of the disclosure.

A photoresist layer 114 is then applied over the hard mask layer 110 (FIG. 21), such as by spin coating, spraying, laminating, etc, and the photoresist layer 114 is imaged and developed to define an open area 116 in the photoresist layer 114 as shown in FIG. 22 to provide an etch mask layer 118. The hard mask 110 is then etched to define the open area 116 within the hard mask layer 110. Once the hard mask 110 is etched as provided in FIG. 23, the photoresist etch mask layer 118 may be removed from the hard mask 110 (FIG. 24), and etching is resumed in the planarization layer 112 to provide fluid access to heater resistor 20 (FIG. 25). At this point, mechanical polishing techniques such as chemical mechanical polishing (CMP) may be used to further planarize the surface before other structures, such as a nozzle plate 122 (FIG. 26) are attached to the micro-fluid ejection head structure 124 (FIG. 25). Alternatively, the hard mask layer 110 may be removed as shown in FIG. 27, leaving a top surface 126 consisting of the uppermost dielectric layer 108 which may be polished prior to attaching a nozzle plate 122 thereto.

Figure 28:
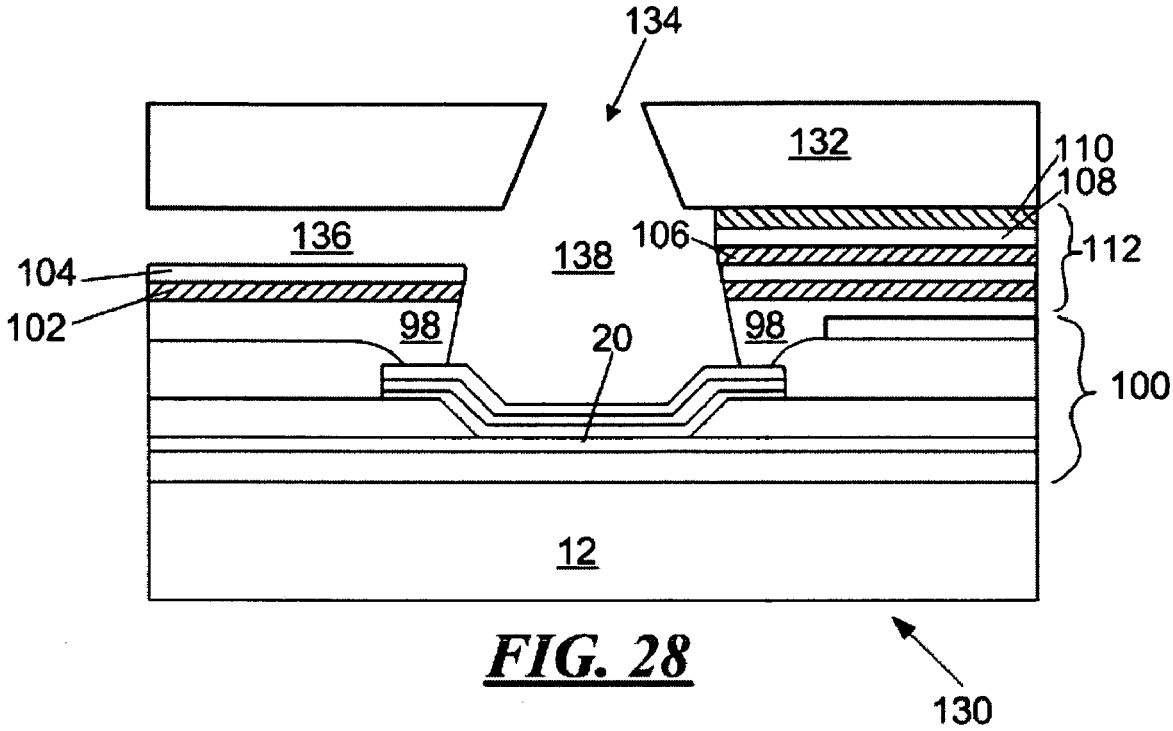
FIG. 28 is a cross-sectional view, not to scale, of a portion of a micro-fluid ejection head according to yet another embodiment of the disclosure.

With reference to FIG. 28, yet another embodiment of the disclosure is provided. According to this embodiment, a portion of a micro-fluid ejection head 130 is illustrated. The micro-fluid ejection head includes the substrate 12, the device layers 100, and the planarization layer 112 as described with reference to FIGS. 14-26. However, rather than attaching a nozzle plate 122 as described with reference to FIG. 26, a nozzle plate 132 containing only nozzle holes 134 is attached to the planarization layer 112 on the substrate 12 and device layers 100. In this embodiment, prior to attaching the nozzle plate 130, flow features including a fluid supply channel 136 and a fluid ejection chamber 138 are etched in the planarization layer 112 as described above. It will be recognized, by those skilled in the art, that the fluid supply channel 136 and fluid ejection chamber 138 may also be formed partly in the nozzle plate 130 and partly in the planarization layer 112.

While specific embodiments of the disclosure have been described with particularity herein, it will be appreciated that the disclosure is susceptible to modifications, additions, and changes by those skilled in the art within the spirit and scope of the appended claims.

What is claimed is:

1. A substantially inorganic planarization layer for a micro-fluid ejection head substrate to which another surface is attached to provide a micro-fluid ejection head comprising a plurality of layers composed of one or more dielectric compounds and no more than one spin on glass (SOG) layer, the planarization layer having a thickness ranging from about 1 microns to about 15microns and being deposited over a second metal layer of the micro-fluid ejection head substrate, wherein a top most layer of the planarization layer is selected from one or more of the dielectric compounds and a hard mask material.

2. The planarization layer of claim 1, wherein the one or more dielectric compounds are selected from the group consisting of silicon oxide, silicon carbide, silicon nitride, and diamond like carbon (DLC).

3. The planarization layer of claim 1, wherein the planarization layer further comprises a passivation layer.

4. The planarization layer of claim 1, wherein the top most layer comprises a hard mask material.

5. The planarization layer of claim 1, wherein the plurality of layers comprises a single layer of SOG between layers of dielectric compounds.

6. The planarization layer of claim 1, further comprising flow features etched therein for the micro fluid ejection head substrate.

7. A substantially inorganic planarization layer for a micro-fluid ejection head substrate to which another surface is attached to provide a micro-fluid ejection head comprising a plurality of layers deposited over a second metal layer of the micro-fluid ejection head substrate, the plurality of layers being composed of one or more dielectric compounds and no more than one spin on glass (SOG) layer, the planarization layer having etched therein at least a portion of a flow feature selected from the group consisting of a fluid flow channel and a fluid ejection chamber, wherein a top most layer of the planarization layer is selected from one or more of the dielectric compounds and a hard mask material.

8. The planarization layer of claim 7, wherein the one or more dielectric compounds are selected from the group consisting of silicon oxide, silicon carbide, silicon nitride, and diamond like carbon (DLC).

9. The planarization layer of claim 7, wherein the planarization layer further comprises a passivation layer.

10. The planarization layer of claim 7, wherein the top most layer comprises a hard mask material.

11. The planarization layer of claim 7, wherein the plurality of layers comprises a single layer of SOG between layers of dielectric compounds.

12. The planarization layer of claim 7, wherein the planarization layer has a thickness ranging from about 1 to about 15 microns.

* * * * *